United States Patent [19]

Higgins et al.

[11] Patent Number: 5,001,992

[45] Date of Patent: Mar. 26, 1991

[54] APPARATUS FOR REGULATING AIR FLOW THROUGH AN AIR PORT OF A CHEMICAL RECOVERY FURNACE

[75] Inventors: Daniel R. Higgins, Portland; Robert B. Hill, Beaverton, both of Oreg.

[73] Assignee: Anthony-Ross Company, Beaverton, Oreg.

[21] Appl. No.: 428,869

[22] Filed: Oct. 30, 1989

[51] Int. Cl.[5] ..... F23L 5/00; F23L 13/00; F23L 13/10; C21B 7/16

[52] U.S. Cl. ..... 110/182.5; 110/297; 15/246; 266/266

[58] Field of Search ..... 110/163, 173, 175 R, 110/175 A, 182.5, 297, 238; 126/285 R, 286; 251/279; 266/266; 15/246

[56] References Cited

U.S. PATENT DOCUMENTS 4,706,324 11/1987 Goodspeed ..... 15/246
4,838,182 6/1989 Goodspeed ..... 15/246
4,846,080 7/1989 Ross et al. ..... 110/182.5

*Primary Examiner*—Henry A. Bennett
*Assistant Examiner*—Christopher Kilner
*Attorney, Agent, or Firm*—Dellett, Smith-Hill and Bedell

[57] ABSTRACT

Apparatus for regulating air flow through an air port in a chemical recovery furnace. A plenum having an adjustable damper mounted inside a wind box associated with the furnace adjacent to the an air port supplies and regulates the flow of air from the wind box to the furnace through the air port. A metal cleaning head adapted for rotatable insertion into the air port for cleaning excrescent material from the peripheral edges of the air port without blocking air flow through the port is pivotally mounted in a retracted, at-rest position adjacent to and above the air port so as not to interfere with movement of the adjustable damper. During a cleaning cycle, the damper is moved to a retracted position on the floor of the plenum so as not to interfere with the moving cleaning head. A short stroke, double articulated damper positioning mechanism facilitates movement of the damper blade in limited space.

11 Claims, 8 Drawing Sheets

APPARATUS FOR REGULATING AIR FLOW THROUGH AN AIR PORT OF A CHEMICAL RECOVERY FURNACE

BACKGROUND OF THE INVENTION

The present invention relates to furnaces and particularly to improved apparatus for regulating air flow through a port introducing combustion air into the firebox of a furnace.

Wood pulp for papermaking is usually manufactured according to the sulfate process wherein wood chips are treated with a cooking liquor including sodium sulfide and sodium hydroxide. The wood chips and the cooking liquor, called "white liquor", are cooked in a digester under predetermined heat and temperature conditions. After cooking, the used liquor, termed "black liquor", containing spent cooking chemicals and soluble residue from the cook, is washed out of the pulp and treated in a recovery unit where the cooking chemicals are reclaimed. Without reclamation and reuse of the cooking chemicals, the cost of the papermaking process would be prohibitive.

In the recovery process, the black liquor is first concentrated by evaporation to a water solution containing about 65 percent solids, which solution is then sprayed into the firebox of a black liquor recovery boiler, a type of chemical reduction furnace. The chemical reduction furnace is a reactor wherein the processes of evaporation, gasification, pyrolysis, oxidation and reduction all occur interdependently during recovery of the cooking chemicals. The organic materials in the black liquor, lignin and other wood extracts, maintain combustion in the firebox, and the heat produced dries and melts the spent cooking chemicals as they fall to the floor of the firebox, where they build a mound of material called a char bed. The char bed is further heated to further liquefy the chemicals into a molten smelt that flows out of the furnace through a smelt spout to a collection tank. Concurrently, combustion heat is employed to generate steam in a water wall of the boiler for use as process steam and for generating electricity.

The combustion process requires the introduction of large volumes of air into the firebox, air comprising about 80 percent of the material entering the furnace. The combustion air is distributed by means of wind boxes or ducts disposed at several levels in surrounding relation to the firebox and outside the walls of the furnace. The air is forced into the firebox from the wind boxes through a plurality of passages or ports in the walls of the furnace, viz.: primary, secondary and tertiary air ports. The primary air ports, through which about 40 to 50 percent of the air enters the furnace, are disposed on the side walls of the firebox near the bottom of the furnace and close to the char bed. The air supplied to the primary air ports is at a comparatively low pressure in order to promote a reducing atmosphere in the burning mass of char. The secondary air ports, which are fewer in number than the primary air ports and through which about 35 percent of the air enters the furnace, are disposed around the walls of the firebox, higher than the primary air ports, and usually below the level of the entry conduits through which the black liquor is sprayed into the firebox. Air supplied through the secondary air ports is at a slightly higher pressure in order to promote burning of combustible gases rising from the glowing mass of the char bed. While the primary air ports provide a relatively large volume of air with considerable turbulence for maintaining a fireball in the char bed, the secondary air ports are intended to provide a finer control and distribution of air above the char bed and distribute the air evenly in the black liquor spray to support the combustion thereof. Air is supplied through the tertiary air ports at a still higher pressure to promote combustion of gases rising through the firebox, the tertiary air ports being higher on the wall of the furnace than the secondary air ports.

The black liquor sprayed into the firebox, having a consistency like warm 60 weight oil, swirls, burns and falls toward the bottom of the firebox in the form of combustion products comprising char material and smelt. The smelt and char material contact and flow down the outer walls of the firebox and, cooled by the inflowing air, form excrescent deposits around edges of the air ports, particularly along the top edges of the secondary air ports where the excrescent material builds up and outward under influence of air rushing through the secondary air port. Such buildup of char material can block air flow through a port causing furnace operation to be inefficient and unpredictable with an attendant decrease in the amount of chemicals that can be recovered, a decrease in the amount of steam produced per unit of fuel, and increased emission of noxious gases such as hydrogen sulfide, carbon monoxide and sulfur dioxide. In accordance with customary practice, the char buildup is periodically removed, for example, by manually inserting a cleaning rod into the air ports successively around the boiler or by actuating mechanized cleaning apparatus mounted in the air ports. With the passage of time, and particularly when cleaning is effected by manual rodding of the air ports, undesirable fluctuations in combustion can occur. Gradual buildup of char material intermittently around the furnace can cause substantial changes in the volume of combustion air, as well as changes in air distribution, velocity and pressure.

The volume and distribution of combustion air supplied to the furnace will also vary depending on the load of the furnace and the moisture content of the liquor being reduced. The distribution and volume of air entering a furnace is conveniently adjusted by regulating means such as dampers provided in supply conduits of the wind boxes. Dampers may also be provided at various locations in the wind boxes, and individual air ports may furthermore be provided with a damper, thus making possible a selective distribution of air within each wind box, or in each wind-box passage or each air port, thereby maintaining the desired air supply in all parts of the furnace.

Viewing and access ports are provided in the wind box adjacent to the air ports of recovery furnaces. Monitoring devices such as pyrometers for sensing temperature inside the firebox and television cameras for viewing conditions inside the furnace are often installed in such access ports. A damper installed in the air port may block the view through the viewing port or interfere with the operation of sensors, and it has been necessary in the past to remove the damper before installing a sensor.

Separate apparatus for cleaning openings in a recovery furnace are known. See, for example, U.S. Pat. Nos. 4,423,533 and 4,822,428 to Byron L. Goodspeed. Apparatus combining the function of airport cleaning and air-flow damping are also known, e.g., see U.S. Pat. Nos. 4,748,004 and 4,838,182 to Byron L. Goodspeed and U.S. Pat. No. 4,846,080 to Ross et al. Dual purpose apparatus such as disclosed in the Goodspeed U.S. Pat. No. 4,748,004 can have some disadvantage in either the air damping function or the cleaning function. According to Goodspeed U.S. Pat. No. 4,748,004, the cage-like structure of the cleaning head is enclosed, and the mounting frame is partially or completely enclosed or walled in, so that, for a given position of the cleaning head, air flow tends to be closed off. The position of the cleaning head may be varied to accomplish cleaning or to effect a different air flow. It has been found that a cleaning element utilized as a damper partially or fully blocking an air port, extending somewhat into the air port, may be subjected to excessive heat from the furnace. Moreover, a device designed to function effectively as a damper, when employed for cleaning the air port, may be less effective for that purpose because the damper shape may not be conducive to cleaning the opening. It is thus often desirable to employ a damper that is separate from the cleaning element and that is disposed near but spaced some distance inside the wind box from the air port.

A damper that controls the air flow to a particular air port is, however, ordinarily located somewhat near the air port; toward the top of the air port opening, and consequently could interfere with the operation of the automatic cleaning apparatus installed in the air port. If space were available, a damper might be installed upstream of the cleaning apparatus in the passage supplying air to the air port; however, space adjacent an air port is limited. When a damper is retracted or moved out of the way of cleaning apparatus, it is sometimes necessary to position the damper such that air flow through the passage to the air port is blocked, but this is undesirable because without positive air pressure outside the air port, effluent from the furnace could back flow into the air duct. A retracted damper that blocks the flow of air to the air port can also block the view of an observer attempting to see the furnace interior through a viewing port associated with the air port opening, or interfere with apparatus such as sensors inserted into the plenum.

Ross et al in U.S. Pat. No. 4,846,080 disclose apparatus that positions the damper in a full open position, in longitudinal orientation with respect to the plenum containing the apparatus, and which then retracts the damper longitudinally away from the air port opening and out of the way of other devices such as cleaning apparatus and sensors. While this mechanism functions efficiently and satisfactorily, the longer length of the plenum required to house the apparatus has been found to be a problem in some installations. Further, when the cleaning head requires service or replacement, it has heretofore been necessary to remove the plenum from the air port.

It is accordingly a primary object of the present invention to provide improved apparatus for regulating the flow of combustion air in a chemical recovery furnace.

It is a more particular object of the present invention to provide improved air regulating apparatus installable in an air port of a chemical recovery furnace and including a damper mechanism that operates cooperatively in a foreshortened plenum with air port cleaning apparatus.

It is another object of the present invention to provide separate air damping and air port cleaning apparatus operating cooperatively inside a plenum, either of which can be removed from the plenum.

Another object of the present invention is to provide improved air regulating apparatus for increasing the operational stability of a black liquor recovery boiler.

It is another object of the present invention to provide improved apparatus installable in an air port of a chemical recovery furnace for regulating air flow through the air port, which apparatus can be retracted without interfering with the operation of a sensing device associated with the air port wherein the air flow regulating apparatus is installed.

Yet another object of the present invention is to provide improved apparatus installable in an air port of a chemical recovery furnace for regulating the flow of combustion air through the air port, said apparatus being retractable without blocking air flow through the air port.

It is a further object of the present invention to provide improved apparatus regulating air flow through an air port of the furnace of a black liquor recovery boiler for enhancing the efficiency of chemical recovery, increasing steam production, and reducing emissions of sulfur dioxide and carbon monoxide.

SUMMARY OF THE INVENTION

According to the present invention in a preferred embodiment thereof, a furnace air port is provided with apparatus including an adjustable damper mounted adjacent the port and a cleaning head removably and pivotally mounted in a plenum adjacent the port, the cleaning head being adapted for automatic insertion into the air port and partially inside the firebox vertically beyond an edge of the air port to dislodge excrescent material built up on the edge. Means are provided for lowering the damper in the plenum out of the way of the cleaning head and moving the cleaning head into the air port during a cleaning cycle, with subsequent retraction of the cleaning head and repositioning of the damper after cleaning has been accomplished.

According to an embodiment, a damper positioning mechanism comprises a slotted bell-crank lever pivotally attached at one end to a bracket which is affixed to the plenum structure, and at the other end to the damper blade, so that the lever is essentially parallel with the damper blade when the damper is functionally positioned. A floating pivot is journaled both in the slot of the lever and in an irregular cam slot affixed to the plenum. When the positioning mechanism is actuated in the damping portion of the cycle, the distal end of the damper is forced downwardly into the air stream to a desired damping position, and when further actuated past the fully-closed position of the damper, the proximal end of the damper is forced downwardly in the plenum until the damper lies essentially on the floor of the plenum.

The cleaning and damping apparatus according to the present invention are each easily removable from the air port for replacement or servicing. In particular, a pivot around which the cleaning head rotates wedges into the end of the plenum adjacent to the air-port opening, the cleaning head assembly being held in place inside the plenum by rods attached at one end to the pivot and extending the length of the plenum where the rods are fastened at the other ends to a faceplate of the plenum. For replacement or servicing, the cleaning head assembly is thus easily removable from the plenum, without having to remove the plenum from the wind box. The damper mechanism is likewise affixed to a plate removably attached to a flange on the external wall of the plenum. The plate and the damper mechanism attached thereto are thus easily removable.

The apparatus according to the instant invention is suitably operated at regular intervals on an automatically timed basis so as to keep the air port substantially clear of excrescent material and without substantially interfering with air flow damping, which results in improved stability of furnace operation. Consequently, more efficient recovery of chemicals is realized, as well as an increase in steam production and decrease in the emission of pollutant gases. Although only a single apparatus according to the present invention is illustrated and described herein, it is understood that a plurality of such apparatus are ordinarily disposed around a particular firebox so as to clean a comparatively large number of air inlets. The separate apparatus can be operated either sequentially or simultaneously.

BRIEF DESCRIPTION OF THE DRAWINGS

While the invention is set forth with particularity in the appended claims, other objects, features, the organization and method of operation of the invention will become more apparent, and the invention will best be understood by referring to the following detailed description in conjunction with the accompanying drawing in which:

DESCRIPTION OF THE PREFERRED EMBODIMENT

Figure 1:
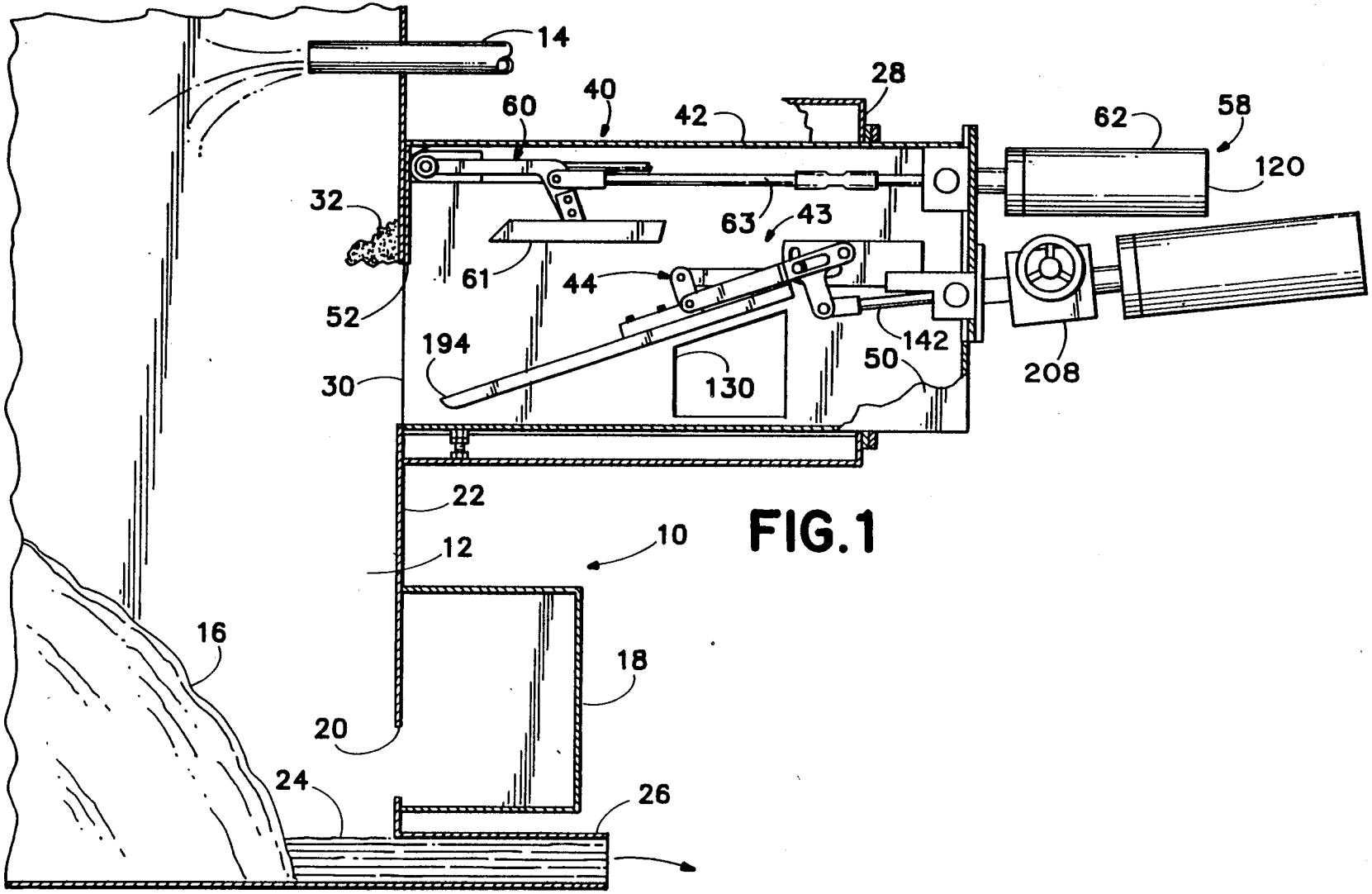
FIG. 1 is a cutaway, somewhat schematic view of a portion of a black liquor recovery boiler with which the present invention may be employed, and showing one embodiment of the invention installed therein.

Referring now to the various views of the drawing for a more detailed description of the components, materials, construction, function, operation and other features of the instant invention by characters of reference, FIG. 1 illustrates a black liquor recovery boiler 10, which comprises a firebox 12 of a steam boiler. Black liquor sprays from a conduit 14 into the firebox 12, where the organic materials in the black liquor ignite, the resulting chemicals and combustion products falling to the floor of the firebox as a char bed 16. A first wind box 18 substantially surrounds the firebox 12 and delivers combustion air under pressure into the firebox through a plurality of primary air ports 20 formed in the wall 22 of the firebox 12 around the periphery thereof at the level of the char bed 16 to maintain a fireball in the char bed. Molten chemical-containing smelt 24 drains from the burning char bed 16 through smelt spouts 26 disposed in the bottom of the firebox 12, and collects in vessels (not shown) for further treatment.

A second wind box 28 substantially surrounds the firebox 12 and delivers combustion air under pressure into the firebox through a plurality of secondary air ports such as air port 30 formed in the wall 22 of the firebox 12 around the periphery thereof above the char bed 16 and below the level of the black liquor entry conduit 14, the air entering the secondary air ports supporting the initial combustion of the organic materials in the black liquor. Excrescent material 32 comprising hardened smelt and char material forms on the walls 22 of the firebox, particularly above the edges of the secondary air ports 30.

Figure 2:
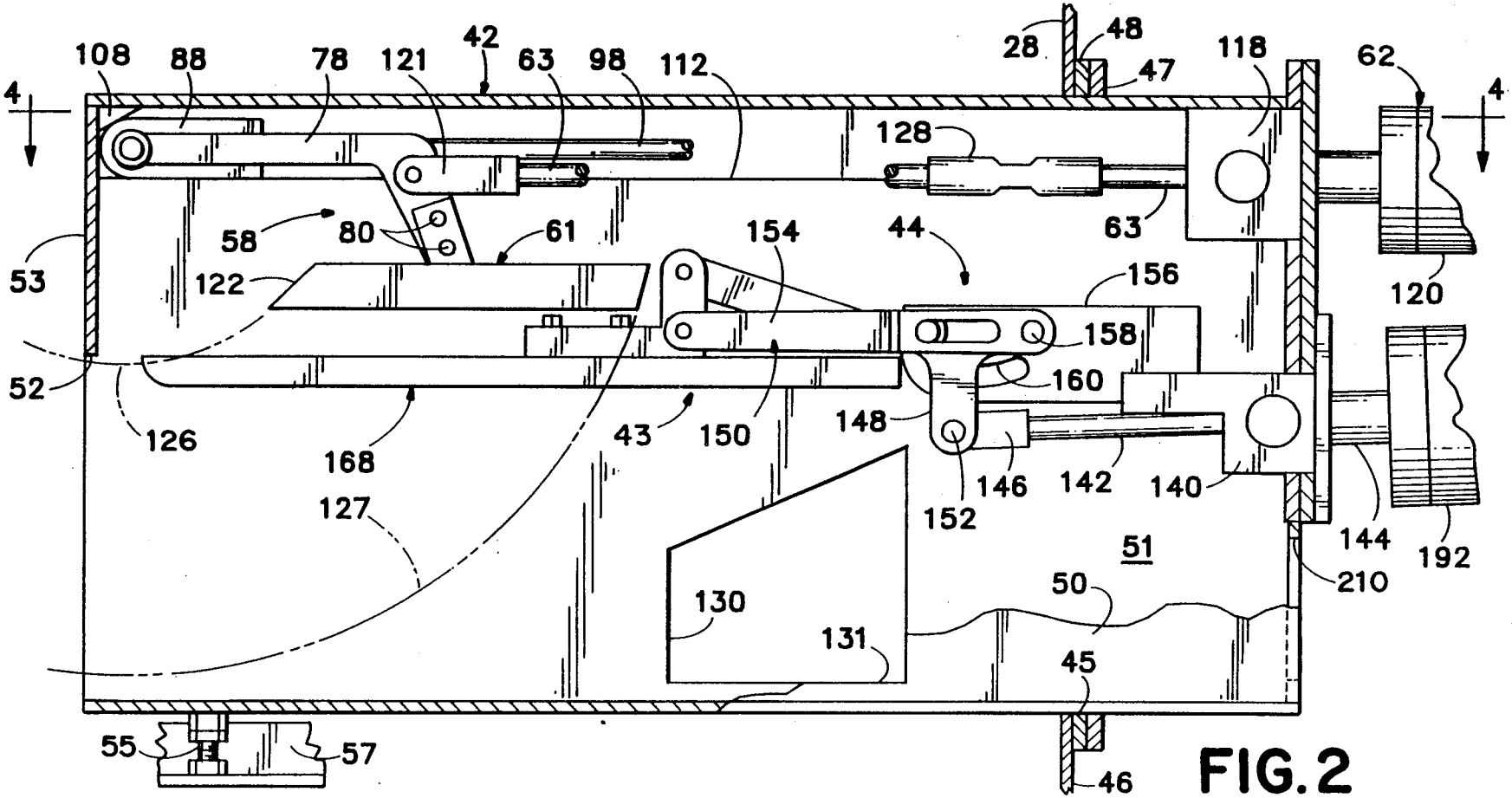
FIG. 2 is a side elevation view, partially cut away, of apparatus according to the instant invention, and showing a damper in the full open position.
Figure 5:
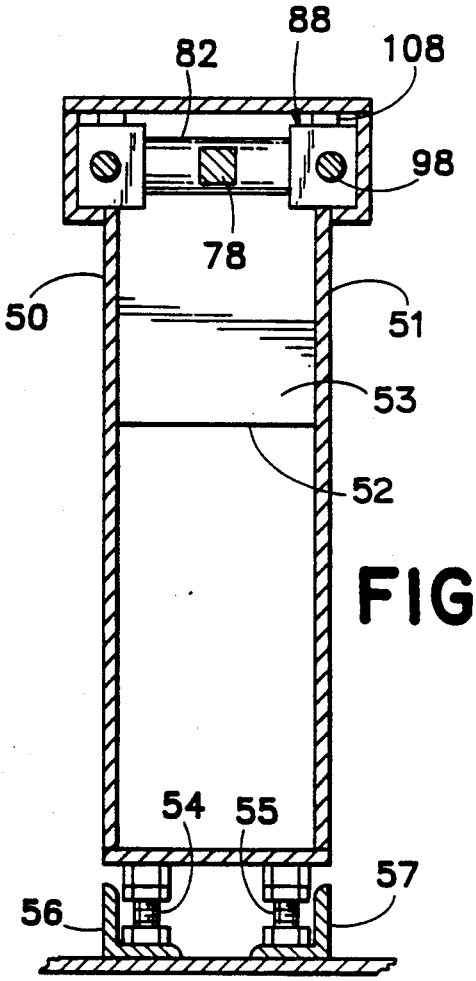
FIG. 5 is a section view taken along lines 5—5 of FIG. 4.

Referring to FIGS. 1-5 but primarily to FIGS. 1 and 2 in accordance with the present invention apparatus 40 installed in the second wind box 28 for regulating the flow of air into the air port 30 comprises a plenum chamber 42 in which a damper assembly 43 mounts for adjustably attenuating the flow of air through the plenum chamber 42 to the air port 30 under control of a damper positioning mechanism 44. The plenum chamber 42 fits through a cutout 45 in the outer wall 46 of the wind box 28 and attaches to the wind box by suitable fasteners (not shown) extending through a mounting frame 47 affixed to the plenum chamber, which fastens to a flange 48 welded to the end wall 46 of the wind box. The plenum chamber 42 is constructed of sheet metal in the form of an enclosed, generally rectangular duct having parallel side walls 50, 51 spaced apart by a distance substantially the same as the width of the air port 30, and an opening 52 in the end wall 53 of the plenum chamber 42, which opening 52 is substantially the same size as the air port 30. The dimensions of the plenum chamber 42 can vary according to the size and shape of the air port 30 and the space available in the wind box. Air ports of chemical reduction furnaces generally are rectangular in shape; however, the shape may vary. The plenum chamber 42 is supported at its forward end by adjustable legs 54, 55 on angle-iron guideways 56, 57 attached as by welding to the wind box 28 and the wall 22 of the furnace. The near side wall 50 of the plenum chamber 42, as viewed in FIGS. 1 and 2, is shown cut away to reveal the apparatus inside the plenum chamber.

Figure 3:
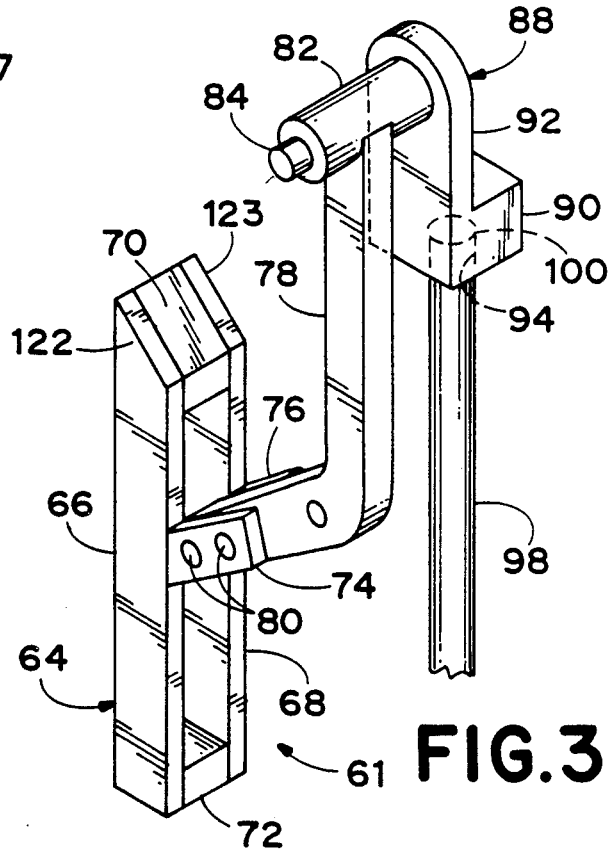
FIG. 3 is a pictorial view of a cleaning head in accordance with the instant invention.

Air flow through the air port 30 is subject to attenuation by constriction of the opening 30 from buildup of excrescent material 32; therefore, according to the instant invention, apparatus 58 for cleaning the air port is mounted inside the plenum chamber 42. Referring to FIGS. 1, 2 and 3, the cleaning apparatus includes a cleaning head assembly 60 having a cleaning head 61 pivotally mounted in a retracted position adjacent the opening 30, and motive means 62 mounted externally of the wind box. An actuating rod 63 extends from the motive means 62 through the plenum chamber 42 for periodically operating the cleaning head 61.

Referring to FIGS. 1–5 and particularly to FIG. 3, the cleaning head 61 comprises a metal frame 64 having parallel elongate sides 66, 68 spaced apart by cross members 70, 72, which are suitable welded therebetween. Alternatively, the frame 64 can be cast as a unitary element. Brackets 74, 76 extending from sides 66, 68 serve to affix the frame 64 to a centrally disposed pivot arm 78 by pins 80, which pass through the brackets 74, 76 and the arm 78. The cleaning head 61 is suitably constructed of heat resistant metal such as stainless steel. The pivot arm 78 depends at its proximal end from a cylindrical sleeve 82 to which it is attached as by welding. A pivot 84 extends through a central aperture of the sleeve 82 and is journaled at either end in L-shaped bearing blocks 86, 88, only one of which (88) is shown in FIGS. 2 and 3 for clarity. Each of the bearing blocks such as the block 88 shown in FIG. 3 is formed with a substantially cubic base portion 90 and a leg portion 92, the base having a bore 94 partially therethrough from the face 96 opposite the leg 92. The cleaning head assembly 60 includes a positioning rod 98, which seats at its distal end 100 in the bore 94 of the bearing block 88, the rod 98 running substantially the length of the plenum chamber. A threaded proximal end 102 of the rod 98 extends through an aperture of faceplate 104, a jam compression nut 106 holding the cleaning head assembly in place and urging the forward end of the leg 92 of bearing block 88 against a wedge 108 (see FIG. 2) welded in the forward end of the plenum chamber 42. Longitudinal channels 110, 112 formed at the top of the plenum chamber 42 and extending laterally outward from the side walls 50, 51 provide guideways which the bearing blocks 86, 88 slidably engage and along which the positioning rods 98, 99 are disposed for installing the cleaning head assembly 60 in the plenum chamber 42. The channels 110, 112 are truncated toward the end wall 53 of the plenum chamber, the narrowed channels 114, 116 receiving the legs of the bearing blocks 86, 88. The cleaning head assembly 60 is thus easily installed and removed from the plenum chamber for servicing or replacement.

The actuating rod 63 connects pivotally and slidably through a mounting assembly 118 to actuating cylinder 120, preferably an air operated cylinder, for slidably advancing the rod 63 toward the opening 52. The actuating rod 63 is pivotally attached to the pivot arm 78 of the cleaning head 61 by a clevis 121 pinned onto the end of the actuating rod 63. The cleaning head 61 is adapted to rotate about the pivot 84 and pass through the rectangular opening 52 into the air port 30 for dislodging excrescent material 32 accumulated in the air port 30. As the cleaning head 61 is extended into and then withdrawn from the opening 52, the cleaning head sweeps the peripheral edges of the air port 30 (see FIG. 12). It will be observed that advancing the rod 63 swings the cleaning head 61 from the retracted position, down and forwardly from the pivot 84, and into the air port 30, defining a locus indicated in FIG. 2 by the dashed line 126 where the end of the cleaning member contacts and dislodges the excrescent material 32. The rod 63 is provided with an adjusting means such as a turnbuckle 128 for adjusting the length of the actuating rod 63 upon installation of the cleaning head assembly 60 in the plenum chamber 42.

Figure 4:
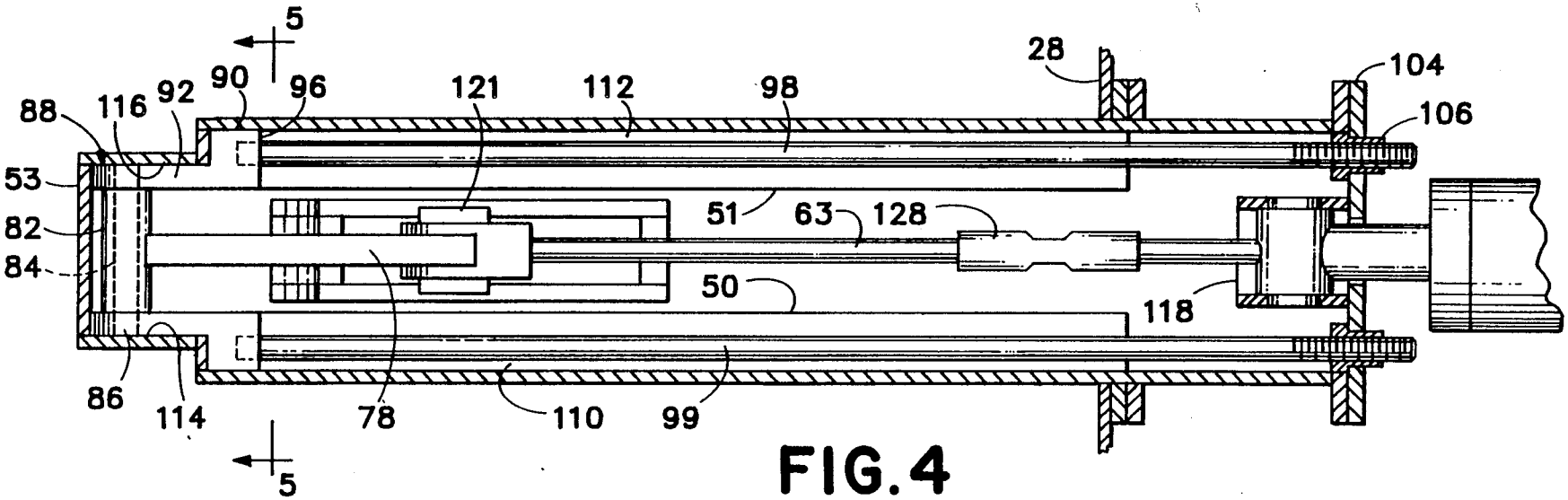
FIG. 4 is a top view taken along lines 4—4 of FIG. 2 showing the cleaning head assembly.

FIGS. 1, 2 and 4 show the cleaning head 61 in a retracted position inside the plenum chamber 42 whereby the adjustable damper assembly 43 can be moved to a predetermined position for adjusting combustion air, which flows from the duct via openings 130, 131 in side walls 50, 51 through the plenum chamber 42 to the opening 52. FIG. 1 shows the damper assembly 43 in a near closed (downward) position for blocking all but a minimal flow of air through the plenum, while FIG. 2 illustrates the damper in a full open position with maximum air flow in the plenum 42.

Figure 6:
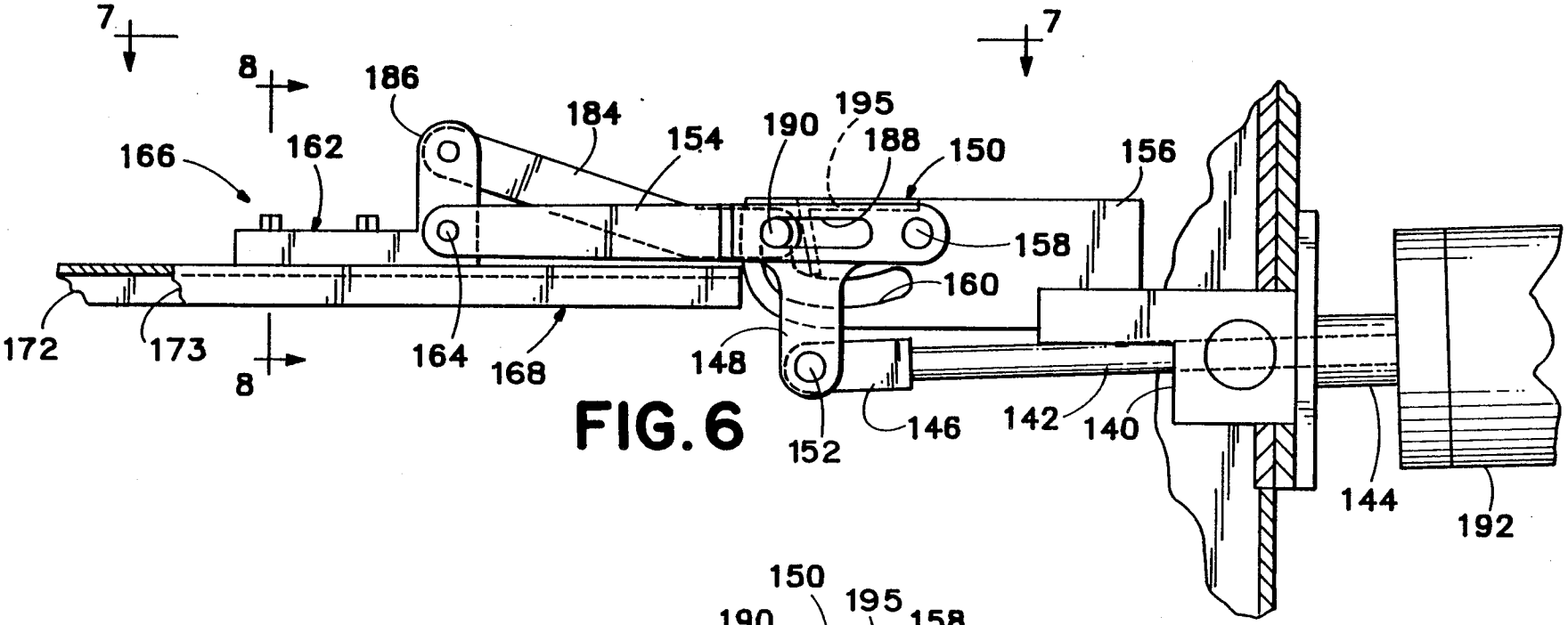
FIG. 6 is a side view of the damper positioning mechanism according to the invention.
Figure 7:
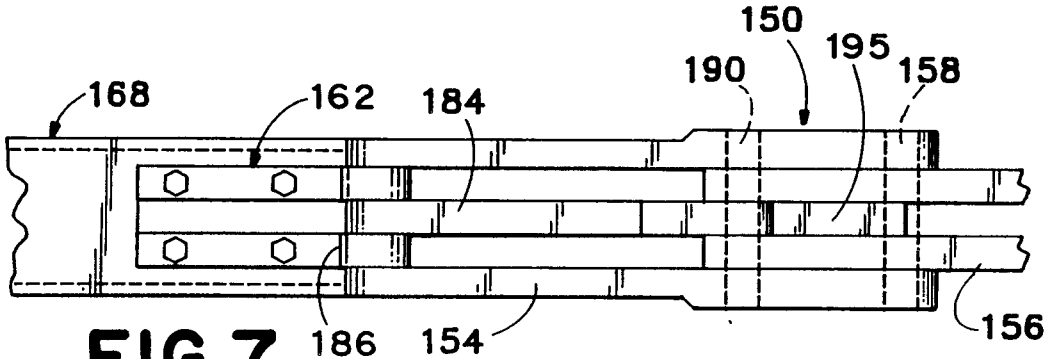
FIG. 7 is a top view of the damper positioning mechanism taken along lines 7—7 of FIG. 6.

Referring now to FIGS. 2 and 6–12, the adjustable damper assembly 43 is illustrated in greater detail comprising a mounting assembly 140 through which a damper actuating rod 142 is slidably and pivotally mounted through fulcrum tube 144 in a manner known in the art. The damper actuating rod 142 is pivotally attached by way of a threaded T-shaped connecting member 146 to arms 148 (only one of which is shown in the figures) of a slotted bell crank pivot member 150, which arms form a clevis between which pivot 152 extends for passing through the centrally disposed connecting member 146. Certain constituent parts of the damper positioning mechanism 44 such as the slotted bell crank pivot member 150 comprise two mirrored elements, one disposed along each side of the damper positioning mechanism as illustrated in FIG. 7; however, for simplicity the instant discussion refers by reference characters only to one of the two like elements.

Longitudinal arm 154 of the pivot member 150 is pivotally attached at one end to a cam-slot pivot bracket 156 by a pivot 158, suitably journaled in bearings (not shown). Cam-slot pivot bracket 156, affixed by welding to the mounting assembly 140, is provided with an arcuate slot 160 having stepwise radii of curvature. The opposite end of the longitudinal arm 154 is pivotally attached to damper bracket 162 by a pivot 164 suitably journaled in bearings (not shown) and disposed adjacent damper 166.

The damper 166 comprises an oblong blade 168 made of sheet metal, U-shaped in cross section (see FIG. 8), and having a flat central span 170 of width slightly less than the interior width of the plenum chamber 42, and lateral flanges 172, 173 depending therefrom. In the presently described embodiment of the invention, the damper blade 168 is approximately 61 centimeters long, 3.2 millimeters thick, and 7.3 centimeters wide. Since the damper blade 168 is fairly closely fit inside the walls 50, 51 of the plenum chamber, the damper blade 168 attaches somewhat loosely to the damper bracket 162 so that the damper blade 168 floats freely inside the plenum chamber as the damper positioning mechanism operates, thereby precluding hang up or snagging of the damper blade on the walls of the plenum chamber. The attachment means comprises laterally oriented elongate slots 176 in the damper blade 168 and a round floating spacer 178 disposed in each slot, the spacer 178 having a thickness slightly greater than that of the damper blade 168. A bolt 180, washer 181 and nut 182 secure the damper bracket 162 to the spacer 178, which attaches the damper blade 168 to the bracket but allows the blade 168 to move laterally with respect to the bracket 162.

A centrally disposed cam link 184 connects pivotally at one end thereof to the upwardly extending arm 186 of the damper bracket 162, and at the other end to the arcuate slot 160 and a longitudinal slot 188 formed in the longitudinal arm 154 of the bell crank pivot member 150. A floating pivot 190 extends through the slot 188 of the pivot member 150, the arcuate slot 160 in the pivot bracket, and a circular aperture in the cam link 184.

The damper actuating rod 142 connects through the mounting assembly 140 to damper actuating cylinder 192, preferably an air operated cylinder, for slidably retracting the actuating rod 142 in the direction away from the air port 30 to position the damper from a fully open position of the damper 166 as shown in FIGS. 2 and 6 to a predetermined position which results in the desired air flow through the plenum chamber. As the actuating rod 142 retracts, the bell crank pivot member 150 rotates about the pivot 158, and the distal end 194 (see FIG. 1) of the damper 166 descends in the plenum chamber, blocking or partially blocking the flow of combustion air. Plate 195 welded between the parallel members of the pivot bracket 156 from the pivot 158 forward and down to near the inner edge of the arcuate slot 160 blocks air flow between the pivot bracket members.

Figure 9:
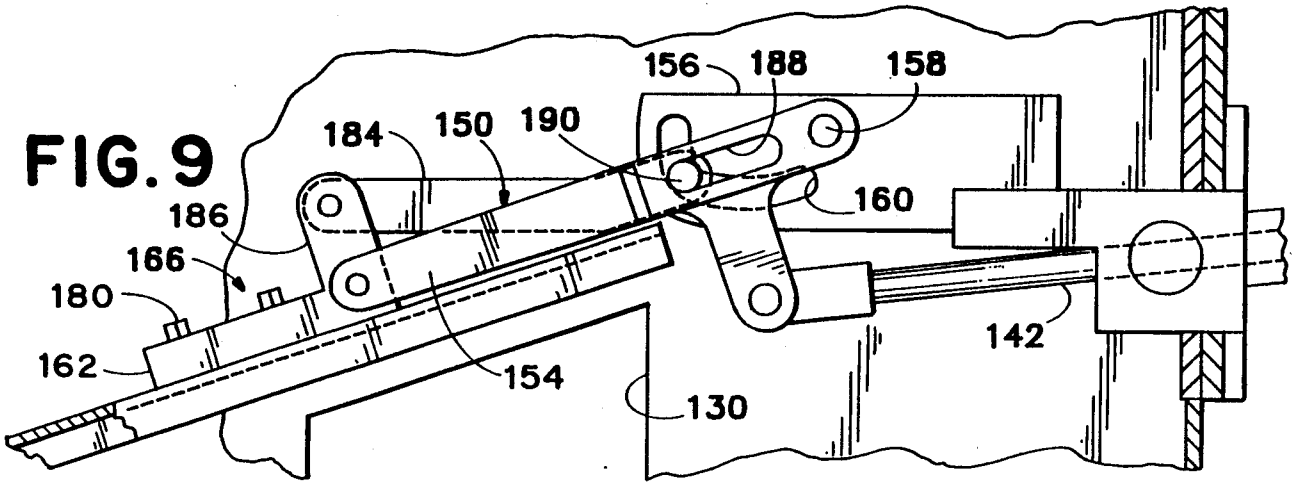
FIG. 9 is a side view of the damper positioning mechanism showing a damper in a full-closed position.
Figure 10:
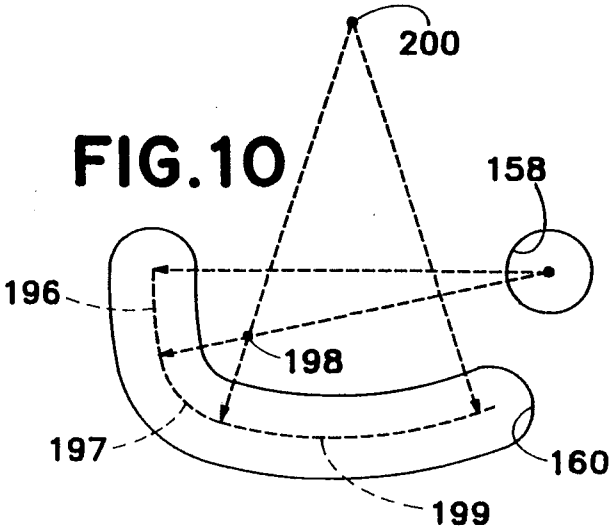
FIG. 10 is a schematic view of the irregular cam slot of the damper positioning mechanism in accordance with the instant invention.
Figure 8:
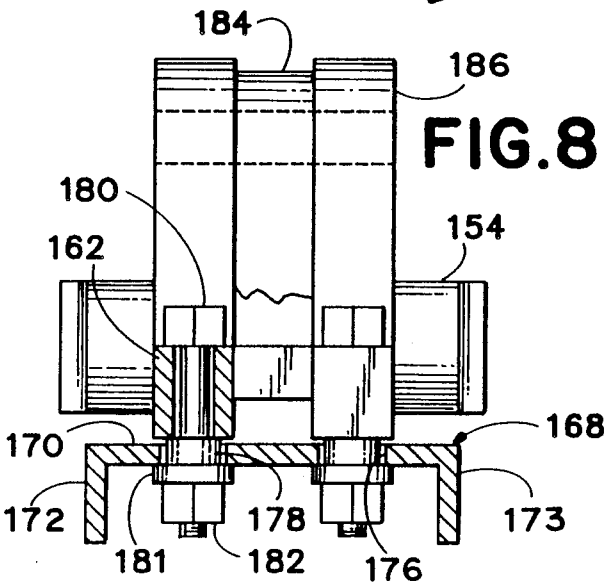
FIG. 8 is a modified section view taken generally along lines 8—8 of FIG. 6.
Figure 11:
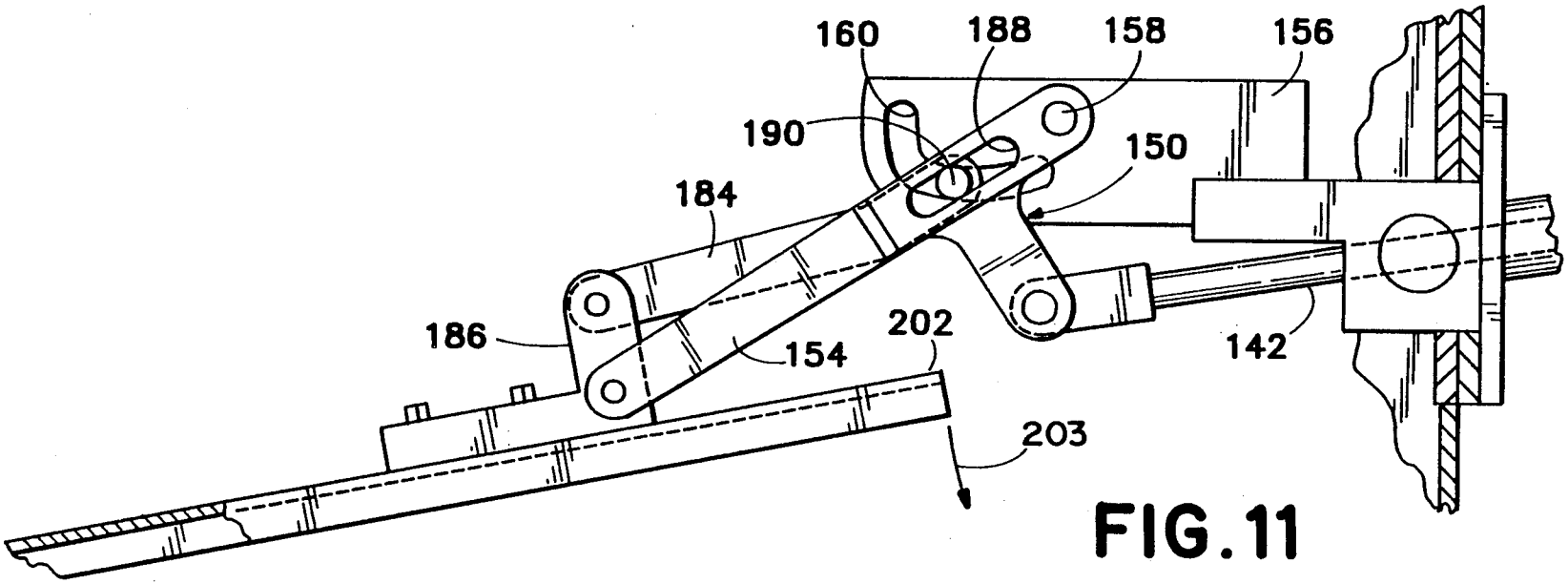
FIG. 11 is a side view of the damper positioning mechanism apparatus according to the instant invention, and showing the damper descending to a retracted position.

Referring to FIGS. 1 and 9, the damper 166 is illustrated in a substantially fully closed position, i.e., with minimal air flowing through the plenum chamber. In such position the floating pivot 190 remains located at the far left-hand end of the longitudinal slot 188 (as viewed in FIGS. 1 and 9), which keeps the cam link 184 positioned such that the damper blade 168 remains essentially parallel with the longitudinal arm 154 of the slotted bell crank pivot member 150, the arms 154, 186 being mutually perpendicular. This condition or mode of damper adjustment exists when the floating pivot 190 (see FIG. 10) is located in a first segment 196 of the arcuate slot 160 having a substantially constant radius of curvature with its center at pivot 158, and also as the floating pivot 190 just begins to traverse a second segment 197 of the arcuate slot 160. The second segment 197, which has a radius of curvature with its apex at point 198, is a transition segment between the segment 196 wherein movement of the floating pivot 190 is nearly vertical, and a third segment 199 of the arcuate slot wherein movement of the floating pivot 190 is more nearly horizontal. Referring to FIGS. 10 and 11, as the actuating rod 142 retracts more, and further rotates the bell crank pivot member 150 about pivot 158 in a clockwise direction, the floating pivot 190 enters and traverses the third segment 199 of the arcuate slot 160 which has a radius of curvature centered at a point 200, forcing the pivot 190 also to traverse the slot 188. This changes the angular relation between the arm 154 of the pivot member 150 and the arm 186 of the damper bracket from a right angle to an acute angle. The changing angular orientation forces the proximal end 202 of the damper blade downwardly in the plenum chamber, as indicated by the arrow 203 in FIG. 11, until the damper 166 is fully retracted to the position illustrated in FIG. 12. In the fully retracted position of the damper, floating pivot 190 has reached the extreme right ends of both pivot slots 160 and 188.

Figure 12:
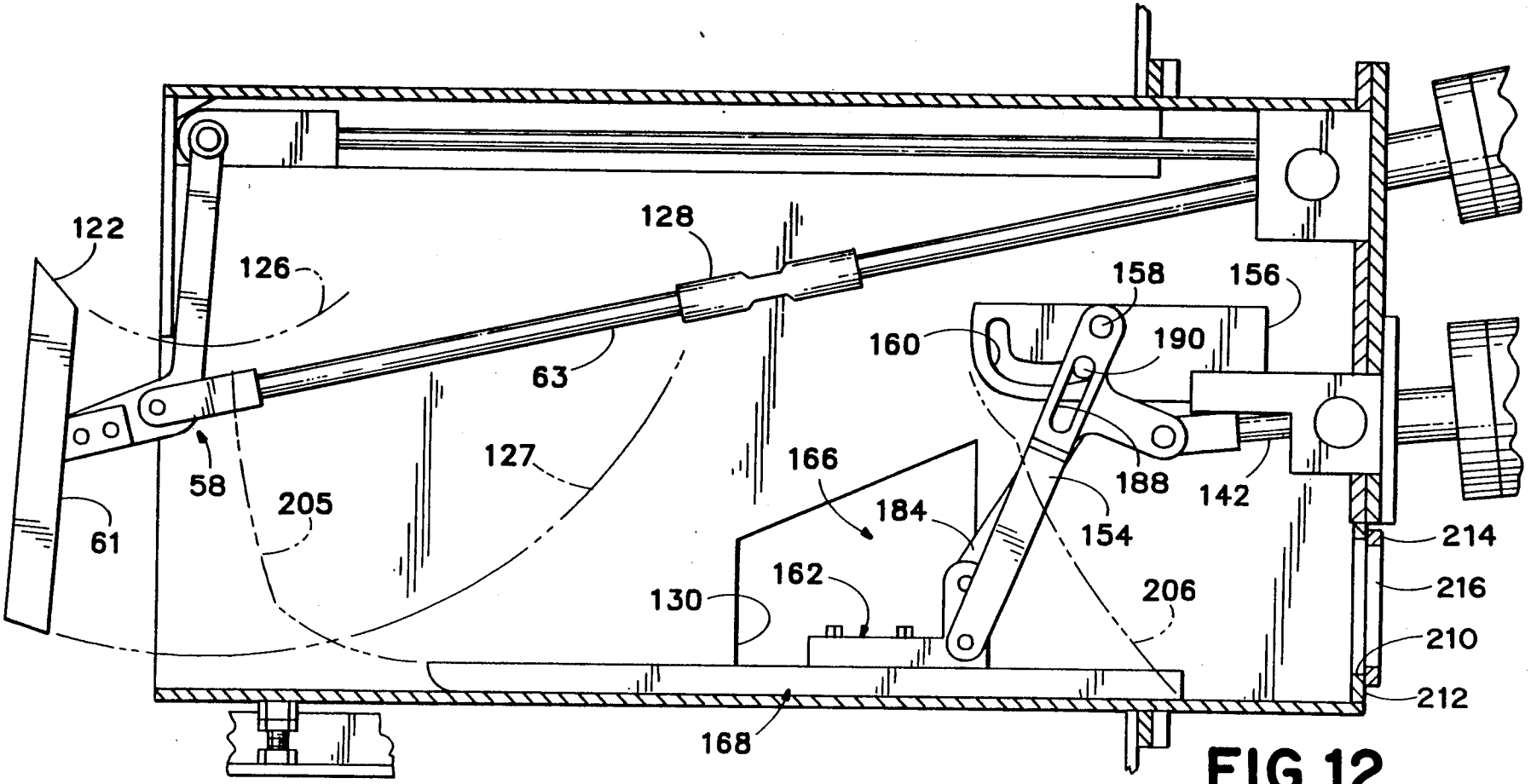
FIG. 12 is a side elevation view, partially cut away, of apparatus according to the instant invention, and showing a damper in the fully retracted position and the cleaning head extended.

It is seen in FIGS. 2 and 12 that the locus of movement of the cleaning head, as illustrated by the dashed semicircles 126, 127, is in mutually interfering relation with the locus of movement of the damper blade 168, shown by the dashed lines 205, 206, FIG. 12. Accordingly, upon initiation of a cleaning cycle, the damper blade is lowered to the retracted position as shown in FIG. 12, which is outside the locus of movement of the cleaning apparatus and allows the cleaning head 61 to be actuated and moved into the opening 52 without interference from the damper blade 168.

FIG. 2 illustrates the cleaning head 61 in an at-rest or retracted position, withdrawn from the air port. It will be observed that the temperature inside the firebox is normally much hotter than in the plenum chamber 42 where the cleaning head 61 normally resides, due in part to the air flow through the plenum chamber 42, and consequently the cleaning head is protected to a degree from the excessive temperature of the firebox except for its brief periods of use. When the damper blade 168 is lowered to the position shown in FIG. 12, air flows freely through the openings 130, 131 into the plenum chamber 42 and positive pressure inside the plenum chamber with respect to the furnace is maintained during the cleaning cycle.

At timed intervals, e.g. about every ten minutes, the cleaning cycle is initiated automatically, and the cylinder 192 is actuated to lower the damper blade 168 to its retracted position as shown in FIG. 12. The cylinder 120 is then actuated, swinging the cleaning head 61 into the air port 30 to the position illustrated in FIG. 12. While the damper is retracted and the cleaning head is in motion, air flows freely into the plenum chamber through the apertures 130, 131. As the cleaning head 61 passes through the opening 52, the cleaning members 66, 68 sweep the peripheral edges of the air port opening, and when the cleaning head is fully extended into the opening, the ends 122 of the cleaning head 61 rise substantially above the upper edge of the opening to dislodge the excrescent material therefrom. The cylinder 192 is then operated in the reverse direction for retracting the cleaning head 61 from the firebox, returning it to its at-rest position as shown in FIG. 2. The damper is then moved from retracted position to essentially the same position it occupied prior to initiation of the cleaning cycle, or to a new position commensurate with the air flow and velocity required through the plenum chamber following removal of material that may have been blocking the air port.

Referring to FIG. 1, when the cleaning apparatus 58 is in the retracted position, optional or vernier damper adjustment apparatus 208, manually operated by a hand wheel, may be actuated to shorten or lengthen the actuating rod 142, which lowers or raises the distal end 194 of the damper 168 in the plenum chamber 42, thereby regulating the air flowing through the plenum into the air port. However, it is understood that automatic means such as the air cylinder 122 or similar means such as a servomotor controlled by a computer is normally utilized to reposition the damper to the desired angular location.

In the presently described embodiment of the invention, the damper blade can descend until the distal end 194 thereof is disposed near the bottom of the air port opening 52, approximately 6.5 centimeters from the floor of the plenum chamber in a specific embodiment, substantially diminishing but not stopping the air flow through the plenum chamber 42. The axial throw of the damper positioning rod 142 from the full-open position of the damper blade (FIG. 2) to the full-closed position (FIGS. 1 and 9) is approximately 3 centimeters.

During a cleaning cycle, the operation of the mechanisms inside the plenum chamber may be viewed from an access port 210 in the outer end wall 212 of the plenum chamber, which access port 210 is suitably provided with a removable closure 214 having a window 216 of heat resistant glass. Alternatively, the access port 210 can be utilized to install a sensing device such as a temperature probe in the plenum chamber, or to mount monitoring apparatus such as a television camera for viewing the char bed 16. Sight means in a region between an access port and an air port is defined by line-of-sight peripheries of the access port and the air port opening, which region may be utilized for visual observation of the air port from the access port and/or for installation of apparatus sensing data pertaining to the air port opening. It is desirable that the sight through the plenum chamber be unobstructed, or alternatively that apparatus obstructing or blocking the sight can be easily retracted out of the way. Although the damper 166 retracts somewhat into the area between the access port 210 and the opening 52, sight is maintained between the elements of the damper positioning mechanism, and auxiliary manual cleaning devices such as a rod can be inserted into the air port through the access port 210 and between the arms of the damper bracket 162. Between cleaning cycles, the adjustable damper assembly 43 can also be raised to the full-open position at any time in order to view the inside of the furnace through the opening 52 or to install monitoring devices. The functioning of the damper positioning mechanism may be viewed through the access port.

A plurality of units of the apparatus according to the present invention are ordinarily installed on a single firebox for the same boiler. The dampers may be adjusted automatically as needed by control means, not shown, responsive to furnace instrumentation to regulate the flow of combustion air entering the secondary air ports. The operation of the cleaning apparatus may likewise be timed by timing means, not shown, to be substantially completely automatic for retracting the dampers and inserting the cleaning heads periodically for quickly cleaning the air ports during furnace operation, withdrawing the cleaning heads and returning the dampers to their previous positions. Apparatus according to the present invention is additionally suitable for use in other air ports, for example, tertiary air ports.

In addition to providing improved efficiency of boiler operation, the present invention enhances operating safety, not only in eliminating the need for manual cleaning and frequent adjustment of dampers to regulate air flow to compensate for clogged air ports, but also in stabilizing the char bed, thereby reducing the danger of hot spots and boiler tube rupture.

While the principles of the invention have now been made clear in the foregoing illustrative embodiment, there will be immediately obvious to those skilled in the art many modifications of structure, arrangement, proportions, the elements, material and components used in the practice of the invention, and otherwise, which are particularly adapted for specific environments and operating requirements without departing from those principles. The appended claims are, therefore, intended to cover and embrace any such modifications, within the limits only of the true spirit and scope of the invention.

We claim:

1. Air flow regulating apparatus, comprising:

a plenum chamber adapted to receive a flow of air therethrough between a first opening for receiving air under pressure and a second opening expelling the air flowing through the plenum chamber;

a damper assembly in the plenum chamber including a damper blade between the first and second openings, means for positioning the damper blade in the plenum chamber, and including means for pivotally mounting the damper blade for rotation about a first pivot of the damper assembly near a proximal end of the damper blade but separate from and non-integral with said damper blade; and actuating means for rotating the damper blade about the first pivot from an initial open position substantially out of the flow of air through the plenum chamber wherein a distal end of the damper blade is adjacent the second opening, such that the distal end of the damper blade moves into the flow of air near the second opening to a position which provides a predetermined air flow through the plenum chamber;

the mounting means including means for pivotally mounting the damper blade for independent rotation about a second pivot of the damper assembly intermediate the proximal and distal ends of the damper blade, said actuating means also rotating the damper blade simultaneously about the second pivot to move the damper blade to a retracted position out of the flow of air and away from the second opening.

2. The air flow regulating apparatus of claim 1 wherein the actuating means includes a third pivot movable in relation to the first and second pivots, said third pivot having an operative connection with said damper blade.

3. The air flow regulating apparatus of claim 2 wherein the actuating means further comprises a first cam member having a first slot in which the third pivot moves, said first slot having a first arcuate segment and a second arcuate segment to impart motion to the third pivot with respect to the first and second pivots, the second arcuate segment having a different radius of curvature than the first arcuate segment.

4. Apparatus regulating air flow through an air port of a firebox, the apparatus comprising:

a plenum chamber having first and second ends, a first opening toward the first end of the plenum chamber and a second opening in the second end of the plenum chamber, the first opening receiving air under pressure to provide a flow of air in said plenum chamber, the air being supplied through the second opening to the air port;

means mounted in the plenum chamber between the first and second openings for damping the flow of air through the plenum chamber to the air port, said means having a proximal end closer to said first opening and a distal end closer to said second opening;

means for mounting the damping means inside the plenum chamber in a retracted position out of the flow of air through the plenum chamber and spaced apart from the second opening, the mounting means including means for pivotally holding the damping means by a first pivot near a proximal end of the damping means but separate from and non-integral with said damping means and a second pivot intermediate the proximal end and the distal ends of the damping means; and means for actuating the damping means including means for pivoting the damping means simultaneously about the first and second pivots such that the distal end of the damping means moves into the flow of air proximate the second opening and the proximal end of the damping means moves through the flow of air to a maximum damping position, the pivoting means including means for further pivoting the damping means about the first pivot to move the distal end of the damping means to a predetermined position where the damping means damps the flow of air through the plenum chamber by a desired amount less than that of the maximum damping position.

5. In a reduction furnace provided with a plurality of air ports in a wall of the furnace, a wind box supplying combustion air under pressure through the air ports to a firebox of the furnace, a plenum chamber in the wind box having a first opening receiving a flow of air from the wind box and a second opening into the firebox through one of the air ports, a damper controlling the flow of air through the one air port, and means for moving the damper including a damper positioning mechanism inside the plenum chamber coupled to the damper, the damper positioning mechanism including means for holding the damper in a retracted position out of the flow of air and spaced apart from the second opening including means for holding the damper pivotally cantilevered above the flow of air through the plenum chamber, the damper being movable into the flow of air to regulate velocity and quantity of the air flowing through the plenum chamber to the second opening, the moving means including an actuator affixed exteriorly of the plenum chamber, and an actuating rod extending into the plenum chamber from the actuator and coupled to the damper through the damper positioning mechanism, the actuating rod, upon being advanced axially into the plenum chamber, moving the damper from the retracted position to a position at least partially blocking the second opening, the improvement comprising:

a first pivot of the damper positioning mechanism near a proximal end of the damper but separate from and non-integral with said damper, and a second pivot of the damper positioning mechanism intermediate the proximal end of the damper and a distal end of the damper, the damper positioning mechanism being responsive to initial movement of the actuating rod from the retracted position of the damper to pivot the damper simultaneously about the first and second pivots such that the distal end of the damper moves into the flow of air proximate the second opening and the proximal end of the damper moves through the flow of air, for moving the damper to a position of maximum damping of the air flow through the plenum chamber, the damper positioning mechanism being responsive to further movement of the actuating rod from the position of maximum damping of the damper to pivot the damper about the first pivot such that the distal end of the damper moves to a predetermined position where the damper damps the flow of air through the plenum chamber by a desired amount less than that of the maximum damping position.

6. In a chemical reduction furnace provided with a plurality of air ports in a wall of the furnace, apparatus regulating a flow of air flow through one of the air ports, the apparatus comprising:

a plenum chamber having a first opening receiving a flow of combustion air under pressure, a second opening expelling the air into the furnace through the one air port, and a floor;

a damper mounted in the plenum chamber, the damper having a distal end and a proximal end;

means for mounting the damper inside the plenum chamber, the mounting means including a damper positioning mechanism having means for holding the damper in a retracted position on the floor of the plenum chamber out of the flow of air between the first and the second openings and spaced apart from the second opening; and means coupled to the damper through the damper positioning mechanism for actuating the damper and including an actuator affixed exteriorly to the plenum chamber, and an actuating rod extending into the plenum chamber from the actuator and attached to the damper positioning mechanism, the actuating rod being adapted for axial movement wherein the actuating rod, upon being advanced axially into the plenum chamber, moves the damper from the retracted position toward the first opening, the proximal end of the damper rising through the flow of air to a position of maximum damping wherein the proximal end of the damper is above the air flow and the distal end of the damper is adjacent the first opening toward the floor of the plenum chamber, and whereupon further axial advancement of the actuating rod into the plenum chamber actuates the damper positioning mechanism to move the distal end of the damper upwardly increasing the flow of air through the plenum chamber.

7. The apparatus of claim 6, wherein the damper positioning mechanism comprises:

a first pivot near the proximal end of the damper but separate from and non-integral with said damper;

a second pivot intermediate the proximal and distal ends of the damper, the damper positioning mechanism being responsive to initial movement of the actuating rod from the retracted position of the damper to pivot the damper simultaneously about the first and second pivots until the damper reaches the position of maximum damping, the damper positioning mechanism being responsive to further movement of the actuating rod to pivot the damper to a greater extent about the first pivot such that the distal end of the damper moves to a predetermined position where the damper damps the flow of air through the plenum chamber by a desired amount less than that of the maximum damping position.

8. Apparatus for regulating a flow of air through an air port of a firebox, the apparatus having a plenum chamber receiving the flow of air under pressure through a first opening therein and supplying the flow of air through a second opening to the air port; means movably mounted in the plenum chamber between the first and second openings for damping the flow of air through the plenum chamber to the air port; first means for selectively moving the damping means to a first position in a locus of movement of the damping means, the first position resulting in a predetermined flow of air through the plenum chamber to the air port; means movably mounted in the plenum chamber for cleaning, during periodic cleaning cycles, excrescent material blocking the air port, the cleaning means being in a retracted position in the plenum chamber during periods between the periodic cleaning cycles, the cleaning means in the retracted position being located in non-interfering relation with the locus of movement of the damping means, the cleaning means having a locus of movement that is mutually interfering with a substantial portion of the locus of movement of the damping means; and second means connected to the cleaning means and operable during the periodic cleaning cycles for moving the cleaning means into the air port to dislodge the excrescent material therefrom and to return the cleaning means to the retracted position, the first moving means being operable before starting a cleaning cycle for moving the damping means from the first position to a second position in the locus of movement of the damping means, the second position being in non-interfering relation with the locus of movement of the cleaning means, and returning the damping means to the first position after the cleaning means returns to the retracted position, wherein the first moving means comprises a damper positioning mechanism having:

a pivot bracket attached interiorly of the plenum chamber, the pivot bracket having an arcuate cam slot formed therein with first and second stepwise segments of different radii;

an elongate bell crank drive member having first and second ends, the first end being pivotally attached to the pivot bracket, the second end being pivotally attached to the damping means, the elongate bell crank drive member having a linear slot formed therein between the first and second ends;

motive means for driving the elongate bell crank drive member;

a cam link pivotally attached to the damping means; and a floating pivot pivotally attached to the cam link and journaled in both the arcuate cam slot and in the linear slot, the floating pivot traversing both slots when the motive means is actuated, the damping means being in the first position when the floating pivot is located in the first stepwise segment of the arcuate slot, and in the second position after the floating pivot traverses the second stepwise segment of the arcuate slot.

9. Air flow regulating apparatus, comprising:

a plenum chamber adapted to receive a flow of air between a first opening receiving air under pressure and a second opening for expelling air flowing through the plenum chamber, a damper blade member in the plenum chamber for regulating the flow of air therethrough, a crank arm pivotally carrying said damper blade member between various damping positions as said crank arm is rotated about a first pivot point, and second arm means for rotating said damper blade member about a second pivot point to assume a retracted orientation with respect to said flow of air wherein said second arm means comprises a link pivotally connected to said damper blade member and further including cam means for constraining said link to follow a path having a center of rotation that changes as said damper blade member is turned by said crank arm to a location where said damper blade member is retracted.

10. Air flow regulating apparatus, comprising:

a plenum chamber adapted to receive a flow of air between a first opening receiving air under pressure and a second opening for expelling air flowing through the plenum chamber;

a damper blade member in the plenum chamber normally located substantially between the first and second openings thereof;

a crank arm pivotally carrying said damper blade member, said crank arm extending between a first pivot fixedly located in said plenum chamber and a second pivot on said damper blade member, said crank arm having a longitudinal slot, a cam member fixed within said plenum chamber and having an arcuate slot including arcuate segments of different radii of curvature, a cam link pivotally connected to said damper blade member at a location offset with respect to said second pivot, said cam link having a movable pivot received in and movable along said longitudinal slot as well as said arcuate slot, and means for turning said crank arm for rotating said damper blade member around said first pivot with respect to the flow of air, and rotating said damper blade member around said second pivot as said movable pivot passes between said arcuate segments having different radii of curvature so as to differently orient said damper blade member with respect to the flow of air.

11. The apparatus of claim 8 including means for removably securing said cleaning means in said plenum chamber.

* * * * *